US011266556B2

(12) United States Patent
Toms et al.

(10) Patent No.: US 11,266,556 B2
(45) Date of Patent: Mar. 8, 2022

(54) MATTRESS WITH AUTOMATIC PRESSURE OPTIMIZATION

(71) Applicant: Linet spol S.R.O., Slany (CZ)

(72) Inventors: Martin Toms, Waterlooville (GB); Ian Ryall, Horndean (GB)

(73) Assignee: Linet spol. s.r.o., Slany (CZ)

( * ) Notice: Subject to any disclaimer, the term of this patent is extended or adjusted under 35 U.S.C. 154(b) by 561 days.

(21) Appl. No.: 16/300,341

(22) PCT Filed: May 3, 2017

(86) PCT No.: PCT/CZ2017/000033

§ 371 (c)(1),
(2) Date: Nov. 9, 2018

(87) PCT Pub. No.: WO2017/194037

PCT Pub. Date: Nov. 16, 2017

(65) Prior Publication Data

US 2019/0142668 A1 May 16, 2019

(30) Foreign Application Priority Data

May 12, 2016 (CZ) ..... PV 2016-277

(51) Int. Cl.

| | |
|---|---|
| ***A61G 7/057*** | (2006.01) |
| ***A47C 27/08*** | (2006.01) |
| ***A47C 27/10*** | (2006.01) |

(52) U.S. Cl.

CPC ..... *A61G 7/05769* (2013.01); *A47C 27/083* (2013.01); *A47C 27/10* (2013.01); *A61G 7/05776* (2013.01)

(58) Field of Classification Search

CPC ..... A47C 27/08; A47C 27/081; A47C 27/083; A47C 27/10; A61G 7/05769; A61G 7/05776

See application file for complete search history.

(56) References Cited

U.S. PATENT DOCUMENTS

| | | | |
|---|---|---|---|
| 5,539,942 | A | 7/1996 | Melou |
| 6,148,461 | A | 11/2000 | Cook |
| 8,844,079 | B2 | 9/2014 | Skinner |

(Continued)

FOREIGN PATENT DOCUMENTS

| | | | |
|---|---|---|---|
| EP | 1716835 | A1 | 11/2006 |
| GB | 2318392 | A | 4/1998 |

OTHER PUBLICATIONS

"How A 2-Way Nomally Closed Solenoid Valve Works". Solenoid Solutions Inc. https://www.solenoidsolutionsinc.com/infographics/how-a-2-way-normally-closed-solenoid-valve-works/. Aug. 8, 2014. (Year: 2014).*

(Continued)

*Primary Examiner* — Peter M. Cuomo
*Assistant Examiner* — Amanda L Bailey
(74) *Attorney, Agent, or Firm* — Thedford I. Hitaffer; Hitaffer & Hitaffer, PLLC

(57) ABSTRACT

The technical solution relates to a mattress for a hospital bed, e.g.: to a therapeutic inflatable mattress and to the improvement of the control system with the help of a detection system comprising a contact member and a valve for optimizing the air pressure in response to the weight distribution and position of the patient on the mattress.

9 Claims, 3 Drawing Sheets

(56) References Cited

U.S. PATENT DOCUMENTS

| | | | | |
|---|---|---|---|---|
| 2001/0039681 | A1* | 11/2001 | Johnson | A61G 7/05769 5/713 |
| 2010/0205745 | A1 | 8/2010 | Nihei | |
| 2011/0041250 | A1 | 2/2011 | Satou | |
| 2012/0124744 | A1* | 5/2012 | Hornbach | A61G 7/012 5/611 |
| 2013/0291310 | A1* | 11/2013 | Liu | A61G 7/05776 5/710 |
| 2014/0059781 | A1 | 3/2014 | Lafleche | |
| 2016/0048134 | A1* | 2/2016 | Thomason | A63F 13/285 700/275 |

OTHER PUBLICATIONS

WIPO, International Search Report, dated Sep. 4, 2017, in International Application No. PCT/CZ2017/000033, filed May 3, 2017.
WIPO, Written Opinion, dated Sep. 4, 2017, in International Application No. PCT/CZ2017/000033, filed May 3, 2017.

* cited by examiner

MATTRESS WITH AUTOMATIC PRESSURE OPTIMIZATION

CROSS-REFERENCE TO RELATED APPLICATIONS

This application, filed under 35 USC 371, is a United States National Stage Application of International Application No. PCT/CZ2017/000033, filed May 3, 2017, which claims priority to CZ Application No. PV 2016-277, filed on May 12, 2016, the disclosures of which are incorporated herein by reference.

TECHNICAL FIELD

The technical solution relates to a mattress for a hospital bed, e.g.: to a therapeutic inflatable mattress and to the improvement of the control system with the help of a mechanical detection system comprising a contact member and a valve for optimizing the air pressure in response to the weight distribution and position of the patient on the mattress.

BACKGROUND ART

Various types of therapeutic mattresses placed on the loading area of the bed are used for hospital beds. Air mattresses are a known type of therapeutic mattress, for example: active and reactive mattresses. Active mattresses can be further classified into alternating mattresses and non-alternating, or constant, mattresses. Alternating mattresses are characterized in that the pressure in individual air chambers changes, and they are mostly used for the treatment of decubitus that has already formed.

The second type of active mattress is the non-alternating mattress, which is characterized in that it typically constantly has a low pressure. In these mattresses, the pressure between the patient and the mattress is as low as possible, but it is not at the point where the patient's body is touching the loading area of the bed. The advantage of a low pressure is the reduced risk of developing decubitus. However, the process of setting the pressure in active non-alternating mattresses is manual, which is time-consuming and inconvenient for both the patient and the staff. Ideally, the air pressure in the mattress should be set so as to prevent the sensitive parts of the body that are susceptible to the formation of decubitus from touching the fixed section of the bed's loading area. When the air pressure is being set, the weight of the patient and the patient's weight distribution on the mattress must be taken into account. However, it is difficult to the set the pressure optimally, and it can also be time-consuming due to the conditions and positions of the patient. The air pressure is often set to a higher pressure then is necessary in order to ensure the patient's safety, which is detrimental to the patient. A preset higher pressure can also cause the development of decubitus if the mattress does not alternate.

Other problems arise when the loading area of the bed is divided to allow the tilting of the backrest into the raised position and the patient is sitting. In this position, there is a greater load on the air chambers in the section where the patient is sitting. If the compressor for adding air is not activated, an active mattress may sink under the patient's weight and the patient is at risk of developing decubitus, depending on his/her weight and the time for which the patient's body is in contact with the fixed section of the loading area.

There is a wide variety of therapeutic mattresses which try to solve the drop in the preset low pressure in various ways and to prevent the sinkage of the mattress under the patient's weight. For example, some mattresses have a preset higher pressure in the lower air chambers, and in the upper air chambers, the lower pressure is regulated with one-way valves that release pressure in relation to the patient's weight. The control device of these mattresses coordinates the inflation of the upper and lower chamber layers separately, so that the lower layer has a higher pressure than the upper layer. An example of such a solution is the U.S. Pat. No. 6,148,461.

Another technical solution is patent application no.: US2014059781 A1, in this technical solution, sensors for detecting the sinkage depth are used to determine the optimum pressure in the mattress. The sensors are located in the mattress chambers, and they generate a signal that indicates the depth of sinkage into the mattress. Furthermore, the mattress includes air pressure sensors that measure the pressure inside the cells. The appropriate inflation level of the mattress is determined by monitoring the rate of change in the sinkage depth with regard to the air pressure in the chambers, the depth at which the patient is positioned on the support surface and the degree of sinkage there will be. The evaluation of the statuses from the sensors is controlled by the control unit, which then determines the amount of pressure to be added to/released from the chambers. Although this technical solution is very sophisticated, it is also very expensive. If the control unit does not have a backup power source, this type of mattress is non-functional and the patient is at risk of developing decubitus. If the evaluation is erroneous or the equipment is faulty, there can be frequent pressure changes in the chambers, which may be uncomfortable for the patient. Patients may feel like they are on a swing or on waves, which may cause some patients to suffer from nausea.

The third well-known technical solution is U.S. Pat. No. 8,844,079B2, which uses data entered by the user to set the optimal pressure, even data based on bottoming-out. Bottoming-out denotes the pressure value of complete sinkage to which a certain constant is then added so that the sinkage is not a target state. This solution uses sensors and control electronics for the evaluation of data, which they use to set the inflation or deflation of the mattress. The disadvantage of this solution is, once again, its dependence on electronics that can fail. The fact that the user may choose the wrong setting to optimize the pressure may be another drawback. Moreover, this solution is very expensive.

SUMMARY OF THE INVENTION

The above disadvantages are solved by a therapeutic mattress that can be placed on a hospital bed, care bed, examination bed, etc.

The technical solution relates to the technical improvement of the therapeutic mattress (hereinafter "the mattress"), wherein its mechanical detection system is designed to prevent the patient from sinking into the mattress and coming into contact with the hard surface of the loading area, and to automatically set the ideal pressure in its air chambers so as to prevent the formation of decubitus on the patient.

The therapeutic mattress is comprised of transverse air chambers and longitudinal air chambers, of which there may a larger number in an advantageous embodiment.

The air chamber consists of an air cushion. In an advantageous embodiment, the air chambers can be made of, for example, plastic, a polyurethane material, rubber or rubber-coated fabrics or of a plastic film. In an alternative embodiment, the mattress can consist of transverse and longitudinal chambers, but it can also have polyurethane foam in, for example, the lower layer below the air chambers or under sections of the air chambers. The mattress is equipped with a compressor that includes a control system comprising: a manifold assembly, a control unit connected to the mattress pneumatically through hoses, for example.

All the mattress chambers are interconnected pneumatically with, for example, hoses that can be equipped in certain places or in certain chambers with a mechanical detection system consisting of a contact member and at least one or more valves. In an advantageous embodiment, the mechanical detection system may be placed in the mattress variably as needed. In an advantageous embodiment, the mechanical detection system comprises a contact member and is equipped with two valves, but in the alternative embodiment, it can have one or more valves. The mechanical detection system allows the mattress to identify a sinkage of the mattress that occurs when the chambers are loaded with the patient's own weight, wherein the contact member sinks and compresses or closes, which allows the relief valve to open or close, and in turn, allows for the immediate lifting of the patient upward away from the surface of the loading area by releasing air from the longitudinal chambers or the plurality of longitudinal chambers (the so-called reservoir) into the transverse chambers or plurality of mattress chambers so as to prevent the patient from coming into the contact with the loading area and developing decubitus. The mechanical detection system is very convenient for the patient, because the detection of the sinkage occurs immediately, as does the release of air from the transverse chambers into the longitudinal chambers, which allows for the patient to be lifted upward away from the surface of the fixed section of the loading area. Another advantage of this system is that it remains functional even if the control system of the mattress through which pressure is added to the transverse chambers of the mattress is without power. This is possible due to the fact that the air in the longitudinal chambers (i.e. the reservoir) containing a higher preset pressure can be used, whereby the air is released into the transverse chambers equipped with a mechanical detection system.

The technical solution we are presenting is very simple, it is not expensive, and it is not dependent on a source of energy in the event of a power or backup source outage. It is, therefore, safer as well.

DESIGN EXAMPLES

Figure 1:
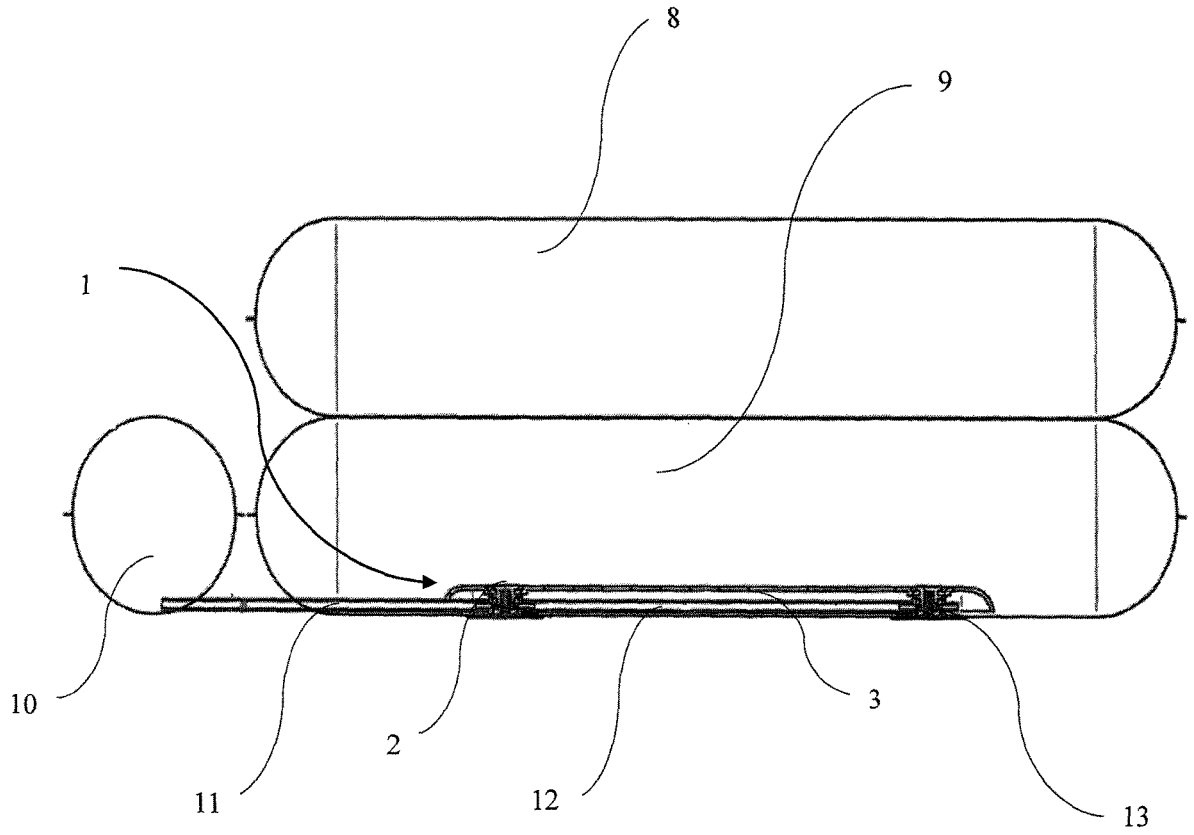
In FIG. 1, there is a cross section through two pluralities of chambers with the location of the mechanical detection system for monitoring the pressure in the mattress.

An embodiment example is mattress 14, e.g., a therapeutic mattress, an alternating mattress etc., FIG. 1 shows the cross section through the air chambers that can be arranged transversely and longitudinally in pluralities. The illustrated embodiment with an advantage displays the plurality of transverse chambers 8 and 9, which are preferably arranged in two superimposed layers wherein the upper transverse chamber 8 is pneumatically connected to the lower transverse chamber 9, which includes detection system 1. The transverse chambers are preferably in two superimposed layers, but in the alternative embodiment, the mattress can have only one layer or multiple layers of chambers of transverse chambers equipped with at least one detection system 1. Mechanical detection system 1 is comprised of contact member 3 and valve 13 and is pneumatically connected to the hoses 11 and 12, and one of the hoses 11 preferably passes through both of the valves 13 of the mechanical detection system 1, while the second tube 12 pneumatically connects the lower transverse chamber 9 to the lateral longitudinal chamber 10 (or so-called reservoir) through valve 13 of mechanical detection system 1. The longitudinal chamber 0 preferably serves as an air reservoir for the transverse plurality of chambers 8 and 9, which contain a constant preset low pressure. The mechanical detection system 1 is used to prevent the patient from subsiding or sinking to the bottom of the mattress so as to prevent him/her from sitting or lying on the hard part of the loading surface and to automatically achieve the inflation of the mattress chambers with the ideal air pressure needed to lift the patient away from the solid surface of the loading area and thereby prevent the formation of decubitus. The upper transverse chamber 8 and the lower transverse chamber 9 are connected in the same plurality and with the same Ps pressure. The Ps pressure can be adjusted manually by the user or the operator based on the recommended values for the data on the patient's weight, which can be obtained, for example, from the scale of the bed or from weighting the patient before he/she is placed on the bed. The second plurality of longitudinal chambers 10 have a PR pressure, where PR is equivalent to the manually set pressure Ps+the preset pressure differential or PR=Ps+preset pressure differential. The valve 13 forms a seal between the plurality of transverse chambers 8 and 9 and the plurality of longitudinal chambers 10. In the alternative embodiment, the longitudinal plurality of chambers comprises one or more chambers 10 with a preset higher pressure and can even have multiple layers.

Figure 2:
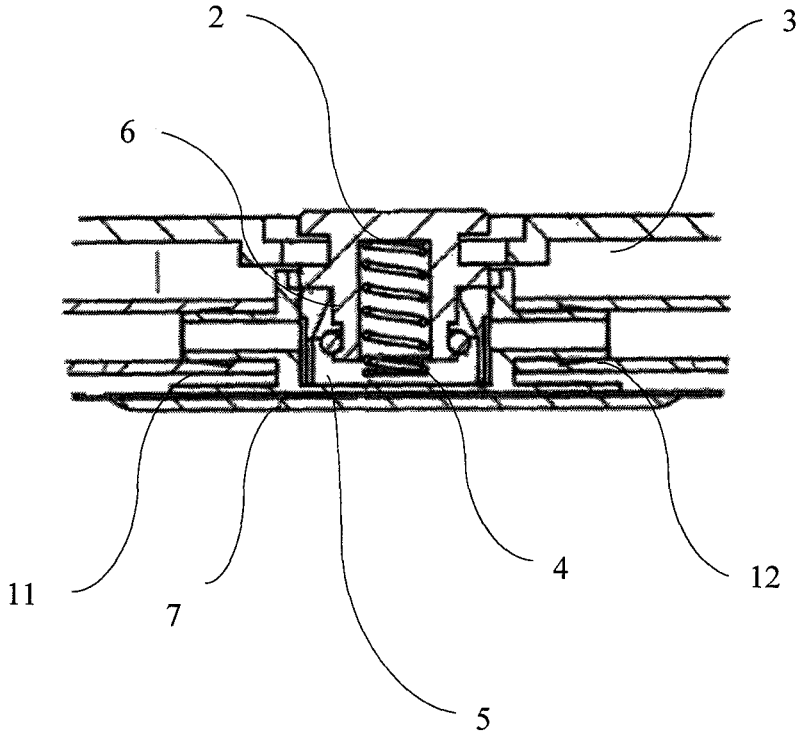
FIG. 2 shows the valve, actuator and valve connection.

The next FIG. 2 shows the cross section of the valve 13, which forms a seal between the plurality of transverse chambers 8 and 9, and preferably with at least one longitudinal chamber 0, and is simultaneously also a part of the mechanical detection system 1 for automatically increasing the air pressure in the supporting transverse chambers 8 and 9 in order to allow the lifting of the patient from the loading area. The body 6 of the valve 13 is mounted in the guide body 7 of the valve 13, which is preferably arranged in the lower part of the transverse chamber 9 in order to reach the maximum depth over the actuator 2 of the valve 3 and the contact member 3. The actuator 2 of the valve 13 is equipped with the O-ring 5, which rests on the sealing surface of the body 6 of valve 13. The valve 13 is normally closed and sealed with a flexible element 4, e.g. spring. The contact member 3 rests on the actuator 2 of valve 13, so that one or both of the valves 13 open when any part of the contact member 3 or actuator 2 of valve 13 is under load. The hose 11 is pneumatically connected to the guide body 7 of valve 13 from the side in order to connect the side of the chamber 10 to the plurality of transverse chambers 9 and 8. The hose 12 connects the second valve 13 to the longitudinal chamber 10 in a series. The number of valves 13 in a series can be varied arbitrarily, depending on the need to cover differently sized areas such as: the entire loading area of the mattress or sections of the loading area of the mattress (e.g., the sitting section), and this system can also be used for mattresses in home care or on chairs and wheelchairs.

Figure 3:
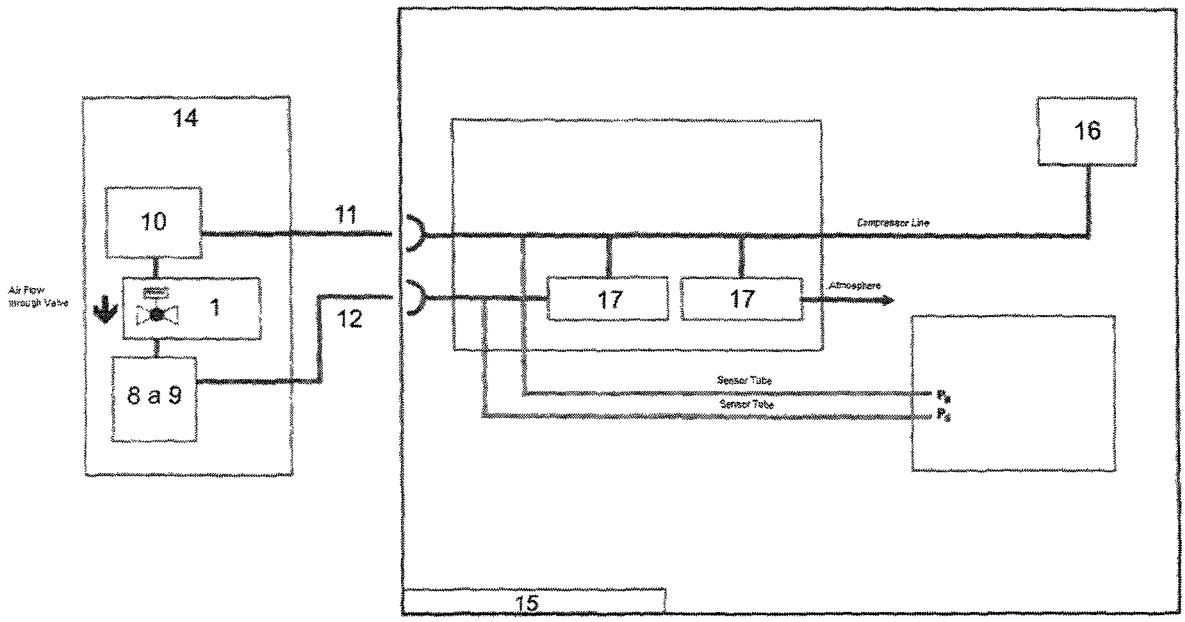
FIG. 3 shows a diagram of the airflow through the chambers and the change in pressure in the individual chambers.

FIG. 3 displays and illustrates a diagram of how the mechanical detection system 1 works to determine the patient's sinkage and the subsequent optimization of pressures in the longitudinal chambers or in chamber 10 or to adjust the pressure in the transverse chambers 9 after they are lifted to the optimal position. When the patient is placed on the upper layer of the transverse chambers 8, the patient sinks into the mattress and there is a pressure deviation in the lower transverse chambers 8 and 9, consequently in certain conditions, this can lead to contact with, or the compression of, the contact member 3 and the opening of the valve 13, and along with the opening of the valve 3, the actuator 2 of valve 13 may be compressed depending on the position of the patient's load, or just a section of the contact member 3 may be compressed and only one of the valves 13 may open. From this it follows that depending on the position of the patient and the weight of the load, one or more valves 13 of the mechanical detection system 1 may open or close. The opening of the valve 13 allows the flow of air through the valve 13 from the longitudinal chambers or chamber 10 to the loaded plurality of transverse chambers 8 and 9. This process causes a drop in pressure in the longitudinal chamber 10, which is sensed and monitored by the PR pressure sensor. This occurs in the control system 15, which is located in the compressor. Consequently, this leads to a rise in pressure in the plurality of transverse chambers 8 and 9, which is sensed and monitored by the Ps pressure sensor. If the Ps pressure increases and the PR pressure decreases, the valve 13 of the mechanical detection system 1 is considered open. The compressor 16 begins to inflate the longitudinal chamber 10, and the air flows through the open valve 13 until the Ps air pressure rises to a level where the contact member 3 or the actuator 2 of the valve 13 is no longer under the load of the patient due to his/her sinkage into the mattress and contact with mechanical detection system 1. At the moment when the mechanical detection system 1 is no longer under load, the valve 13 or plurality of valves 13 close and the Ps and PR pressures equalize to Ps=PR. This then becomes the new ideal pressure determined according to the weight and position of the patient relative to the position on the loading area, which is hereinafter referred to as PN. The compressor 16 will continue to fill the plurality of longitudinal chambers or chamber 10 until the preset pressure between the plurality of chambers 10 and the plurality of chambers 8 and 9 is restored.

Immediately after the restoration of the pressure difference, the control system 15 opens or turns off the solenoid 17 (electromagnetic sensor) and, if necessary, the control system 15 turns on the compressor 16 for the inflation of the chambers 8 and 9 for the supply of a small pressure increase in the plurality of chambers 8 and 9 with a small deviation, which is hereinafter referred to as PD. From this, it follows that Ps=PN+PD.

If the PR pressure decreases at any time, the control system 15 switches on the compressor 16 for inflating the chambers 10 to restore the preset pressure. If the Ps pressure is low, the control system 15 switches on or off the solenoid 17 (electromagnetic sensor) and, if necessary, it switches on the compressor 16 for the inflation of the chambers 8 and 9 to restore the pressure difference. The ideal pressure in the plurality of chambers for lifting the patient in the current mattress position on the loading area is known as PN and is maintained. The air can periodically be intentionally released from the chambers 8 and 9, which allows the patient to sink into the mattress. The ideal pressure in the chambers can be restored and checked in relation to the shape, position and weight of the patient's load. If the patient's position and weight distribution changes, then the routine for determining the optimum air pressure is repeated as well.

The advantage of this mechanical detection system 1 is that it is functional even if the compressor 16 with the control system 15 is either disconnected from the mains or is not powered for some reason. The reason for this is that the longitudinal plurality of chambers or chamber 10 serves as a reservoir with a higher pressure which is connected to the transverse chambers 8 and 9, into which the valve 13 is opened when the patient comes into contact with the contact member 3 or the actuator 2 of the valve 13, which allows air from the chamber 10 into the transverse chamber 9. The patient is thereby lifted above the fixed surface of the loading area and above the mechanical detection system 1 so that the patient is not at risk of developing decubitus.

LIST OF REFERENCE NUMERALS

1 Mechanical detection system
2 Valve actuator
3 Contact member
4 Flexible element (spring)
5 O-ring
6 Body
7 Guide body
8 Upper transverse chamber
9 Lower transverse chamber
10 Side longitudinal chamber (reservoir)
11 Hose
12 Hose
13 Valve
14 Mattress
15 Control system
16 Compressor
17 Solenoid

The invention claimed is:

1. A mattress for automatic optimization of air pressure under a patient comprising:

a control system, and a plurality of inflatable chambers, wherein the control system and all chambers are pneumatically connected, the plurality of chambers comprising a first plurality of chambers connected to a second plurality of chambers, wherein at least one chamber of the second plurality includes a mechanical detection system, which comprises a contact member, an actuator and at least one valve, which is pneumatically connected to at least one chamber of the first plurality of chambers, the mechanical detection system being operable to detect insufficient pressure in the second plurality of chambers and increase pressure in the second plurality of chambers by allowing air to pass from the first plurality of chambers to the second plurality of chambers until sufficient pressure is detected in the second plurality of chambers, the mechanical detection system being operable without electrical power.

2. The mattress according to claim 1, wherein the contact member or the actuator is movable for opening or closing the valve in relation to a load on the contact member or actuator under weight of the patient.

3. The mattress according to claim 1, wherein the mechanical detection system includes two or more valves, including the at least one valve, that are pneumatically interconnected.

4. The mattress according to claim 1, wherein the valve of the mechanical detection system forms a seal between the second plurality of chambers and the first plurality of chambers.

5. The mattress according to claim 1, wherein the mechanical detection system and the chambers are pneumatically interconnected by means of hoses.

6. The mattress according to claim 1, wherein the first plurality of chambers is longitudinal and the second plurality of chambers is transverse.

7. The mattress according to claim 1, wherein at least one plurality of chambers can have one layer of chambers, multiple layers of chambers, or a combination thereof.

8. The mattress according to claim 1, wherein the control system comprises a compressor and a pressure sensor.

9. A method of automatically optimizing the air pressure in the mattress under the patient according to claim 1, wherein the mattress is placed on a device for supporting the patient on a loading area, wherein air pressure in the first plurality of chambers is increased, and air pressure in the second plurality of chambers is decreased, and weight of the patient activates the mechanical detection system, which opens the valve and releases air between the first plurality of chambers to the second plurality of chambers and lifts the patient away from a fixed section of the loading area.

* * * * *